US006325376B1

(12) United States Patent
Elliott et al.

(10) Patent No.: US 6,325,376 B1
(45) **Date of Patent: *Dec. 4, 2001**

(54) TARGET RAISING AND LOWERING DEVICE

(76) Inventors: Jerry R. Elliott, 800 W. Dobbins Rd., Phoenix, AZ (US) 85041; Douglas B. McCarthy, 1010 E. Morrow Dr., Phoenix, AZ (US) 85024

( * ) Notice: Subject to any disclaimer, the term of this patent is extended or adjusted under 35 U.S.C. 154(b) by 0 days.

This patent is subject to a terminal disclaimer.

(21) Appl. No.: 09/391,728

(22) Filed: Sep. 8, 1999

Related U.S. Application Data

(63) Continuation-in-part of application No. 09/153,971, filed on Sep. 16, 1998, now Pat. No. 6,073,932.

(51) Int. Cl.[7] ..... F41J 1/00
(52) U.S. Cl. ..... 273/406; 273/391
(58) Field of Search ..... 273/391, 392, 273/390, 406, 407

(56) References Cited

U.S. PATENT DOCUMENTS 863,486 * 8/1907 Aiken ..... 273/406
4,239,234 * 12/1980 Ward ..... 273/391
4,540,182 * 9/1985 Clement ..... 273/406
5,213,336 * 5/1993 Bateman ..... 273/406
5,350,180 * 9/1994 Acock ..... 273/406
5,431,409 * 7/1995 Webster ..... 273/406
5,695,196 * 12/1997 Yanosky ..... 273/406
6,073,932 * 6/2000 Elliott ..... 273/391

* cited by examiner

*Primary Examiner*—Mark S. Graham
(74) *Attorney, Agent, or Firm*—Charles E. Cates

(57) ABSTRACT

The present invention is a portable pneumatic target device for raising and lowering a target. With the target raising and lowering device of the present invention, a target can be selectively stopped at any point of extension or retraction. The target raising and lowering device of the present invention includes a support frame secured to a base, a horizontal target carrier assembly mounted to the support frame and moveable on the frame, and in air actuated cylinder operably attached to the target carrier assembly. The target is mounted to the target carrier assembly and is raised and lowered through the action of the air actuated cylinder. Pressurized air is selectively admitted into the cylinder by a solenoid operated valve. The solenoid is energized, after actuation of a manual switch or an infrared switch for a predetermined period under control of a programmable timer.

7 Claims, 6 Drawing Sheets

10
13
12
11
15
14
45
47
48
46
55
51
50
53
52
54
30
33
37
82
81
85
34
83
31
31A
35
38
84
36
40
43
42
44
21
26
27
23
22
24
25
20

33A
82A
84A
35
96
83A
30A
91
37
94
95
92
90

TARGET RAISING AND LOWERING DEVICE

This is a continuation-in-part of U.S. patent application Ser. No. 09/153,971, filed Sep. 16, 1998. U.S. Pat. No. 6,073,932. This invention relates to a device for raising and lowering a target for practice shooting.

BACKGROUND OF THE INVENTION

Various devices for raising and lowering targets for practice shooting are known in the art. It is an advantage when one is practicing target shooting to have a target that can raise up from a position of concealment. This allows the shooter to improve shooting skills in a more realistic environment. One such target raising and lowering device is taught by U.S. Pat. No. 863,486. In that patent, an attendant manipulates a pulley system which raises one target while at the same time an opposing target is lowered. U.S. Pat. Nos. 4,288,080 and 4,119,317 teach a transverse shaft rotatable by a motor which is used to propel the target into an upright position. The apparatus disclosed in these patents are an improvement over U.S. Pat. No. 863,486 as a human attendant is no longer placed in harm's way. Nevertheless, these patents are limited to a fixed up and a fixed down position. Accordingly, the apparatus disclosed in these patents cannot be raised so that only a portion of the target is exposed. U.S. Pat. No. 4,540,182 teaches the use of an air-actuated cylinders to raise the target, but the target is limited to a fixed up and down position.

SUMMARY OF THE INVENTION

The portable pneumatic target device of the present invention is an improvement over the devices disclosed in the above-mentioned patents as it incorporates an air actuated cylinder in conjunction with a horizontal target carrier assembly. Consequently, with the present invention, a target can be quickly raised and lowered. A double or single acting air cylinder can be incorporated into the device. When the device is to be mounted onto a vertical surface, it is preferred that a double acting air cylinder be used in order to insure adequate retraction of the device. When the device is mounted on a horizontal surface, either a double or a single acting air cylinder may be used. Using either a double acting or single acting air cylinder, the user can selectively stop the target at any point of extension, which creates more target-shooting challenges. Once the target is stopped at a given position, a double acting air cylinder further allows the target to then be selectively raised or lowered from that point. When a single acting air cylinder is used, the target returns to its lowest resting position by force of gravity. This invention further allows the user to control the speed at which the target is raised and lowered.

It is an object of this invention to provide for a target raising and lowering device wherein the speed at which the target is raised can be adjusted by the user.

It is an object of this invention to provide for a target raising and lowering device that can be raised to a desired extension and then stopped.

It is a further object of this invention to then allow the target device to be raised or lowered from any point of extension.

It is another object of this invention to provide for a target raising and lowering device with a narrow base that can be easily concealed behind obstructions such as barrels and furniture.

It is still another object of this invention to provide for a target raising and lowering device that can free stand or can be easily hung from a wall.

Other objects of the invention will become apparent hereinafter.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE DRAWINGS

Figure 1:
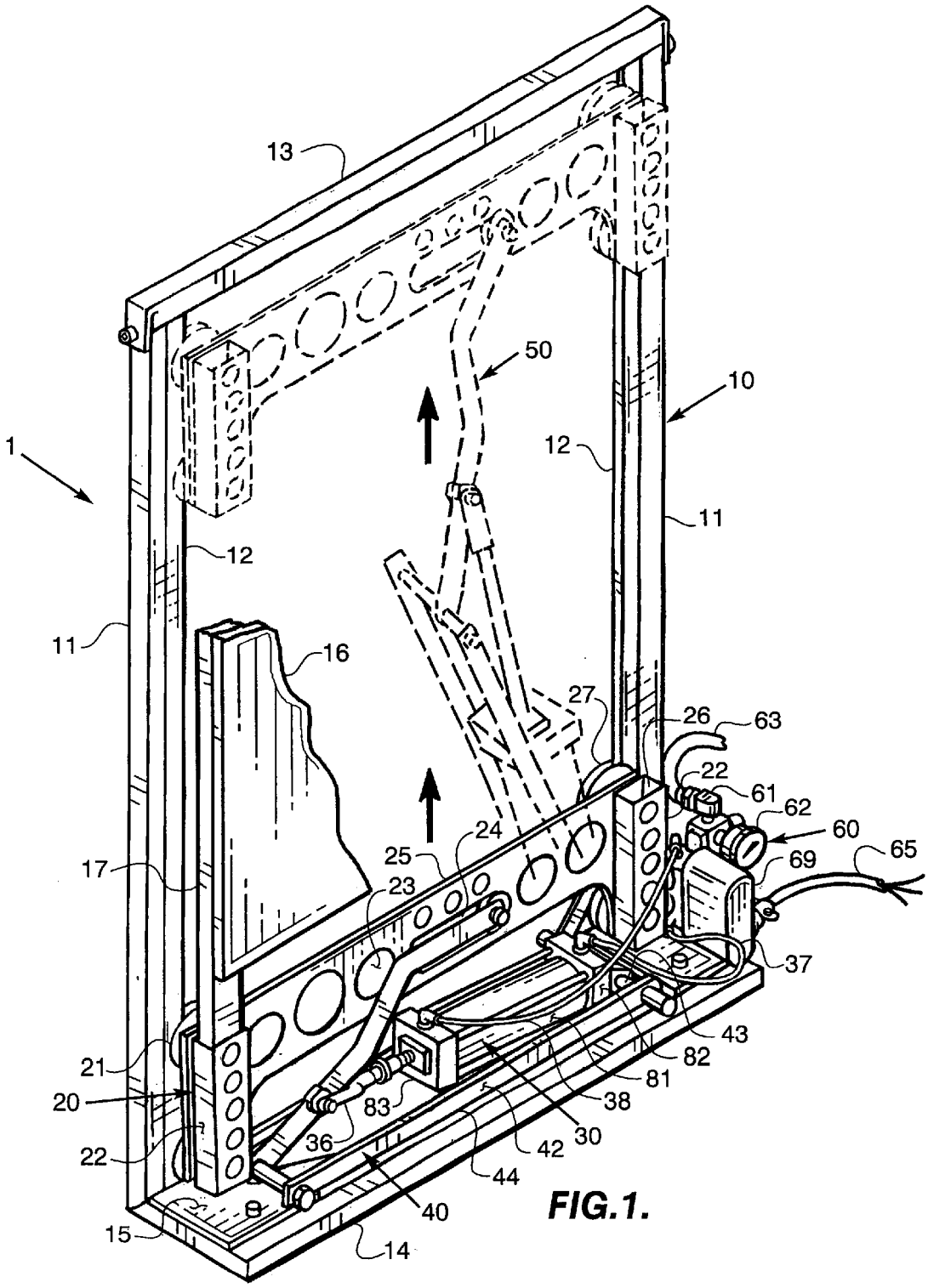
FIG. 1 is a front perspective view of the portable pneumatic target device showing the target carrier assembly 20 in a ready position. The target carrier assembly 20 is shown at its maximum extension in dashed lines.

As shown in FIG. 1, the portable pneumatic target device 1 of the present invention comprises a support frame 10, target carrier assembly 20, air actuated cylinder 30, tension arm assembly 40, idler arm 50, and solenoid control 60.

Figures 6A, 6B, 6C, 6D, 6E:
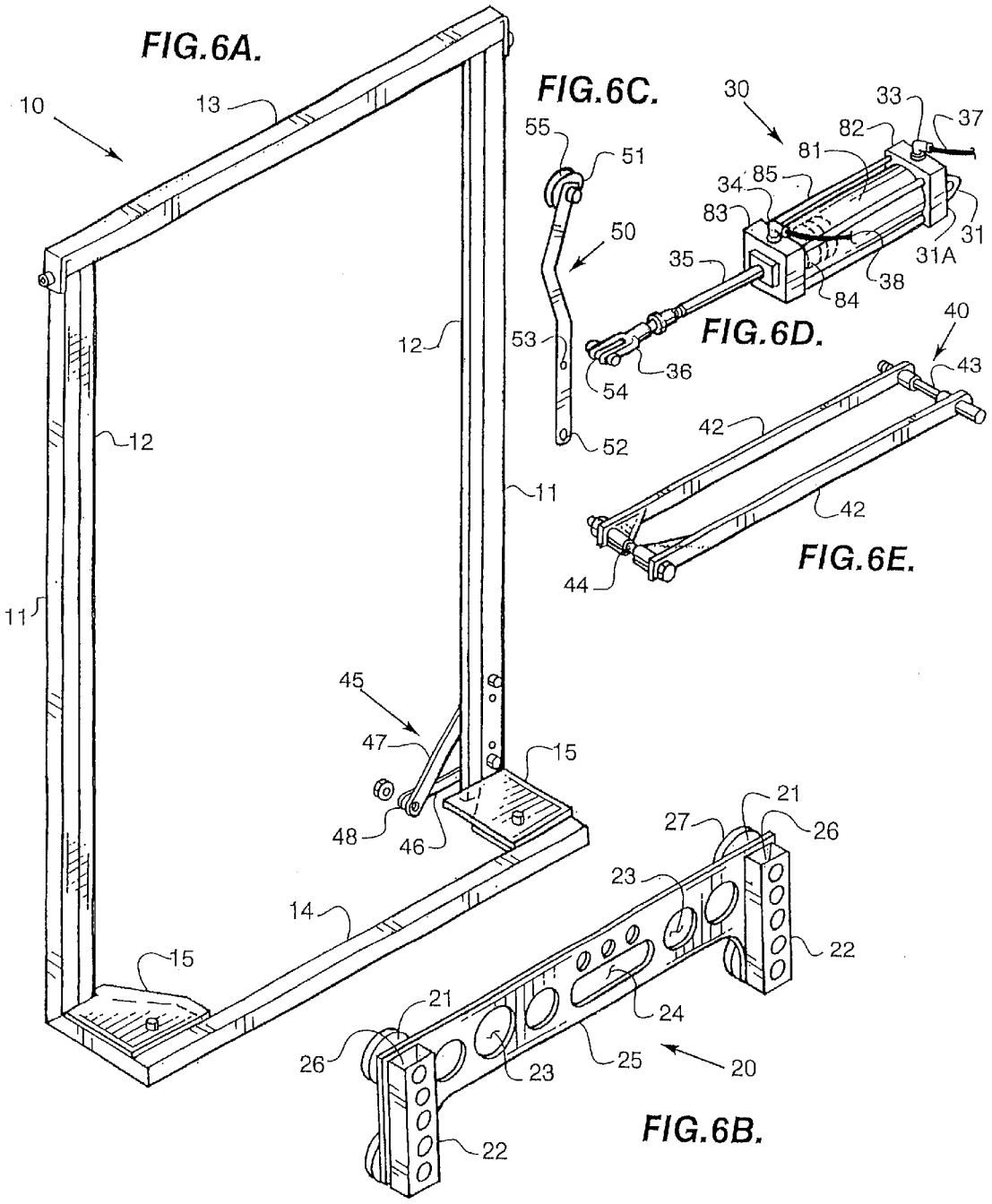
FIG. 6A is a perspective view of the support frame 10.
FIG. 6B is a perspective view the target carrier assembly 20.
FIG. 6C is a perspective view of the idler arm 50.
FIG. 6D is a perspective view of the air actuated cylinder 30.
FIG. 6E is a perspective view of the tension arm assembly 40.

As shown more clearly in FIG. 6A, the support frame 10 includes a base 14 which provides stabilizing support for the target device, and in a preferred embodiment of the invention, the base portion of the frame extends no more than about six inches in front of the frame. Rubber rebound pads 15 are affixed to the upper surface of base 14 to help absorb the impact of target carrier assembly 20 when it is returned from the raised position to the ready position and makes contact with the base. A pair of guide frame bars 11 extend vertically upward from both ends of the base 14 of frame 10. The guide frame bars 11 are connected at the top by horizontal tie bar 13 to form the generally rectangular shaped support frame 10. In an alternate embodiment of the invention, guide frame bars 11 are connected at about their midpoints by a horizontal tie bar comparable to tie bar 13. As shown most clearly in FIG. 4, an L-shaped carrier guide rail 12 is attached to the inner surface of each vertical guide frame bar 11.

As shown in FIG. 1, target carrier assembly 20 is positioned at the front of frame and rests on base 14. As shown more clearly in FIGS. 4 and 6B, target carrier assembly 20 comprises a somewhat rectangular shaped rigid plate 25 which extends between guide frame bars 11. Cut-outs 23 in plate 25 serve to reduce the weight of the assembly.

Mounted on each end of plate 25 and on the front side of the target device are target receptor brackets 22, each of said receptor brackets having a rectangular shaped cavity 26. As shown in FIG. 1, target 16 is mounted to the portable pneumatic target device by target supports 17 which are inserted into cavity 26 of the target receptor brackets 22. Thus, the target can be raised and lowered along with the target carrier assembly 20.

Also mounted at each end of plate 25, and on the side of the plate opposite to the target receptor brackets 22 are rotatable guide rail wheels 21. As shown best in FIG. 4, each end of plate 25 is provided with a pair of such guide rail wheels, and each of the wheels has a groove 27 about the circumference of the wheel. The groove of each guide wheel engages with the guide rail 12 to properly guide the target carrier assembly and target in the raising and lowering operation.

The raising and lowering of the target carrier assembly 20 and target 16 is initiated through the action of air actuated cylinder 30, which is pivotally secured to frame 10 by means of tension arm assembly 40. As shown best in FIG. 6E, tension arm assembly 40 is rectangular shaped and includes a pair of spaced apart parallel bars 42. The bars are connected at one end by means of pivot shaft 43 and at the other end by pivot shaft 44.

Figure 5:
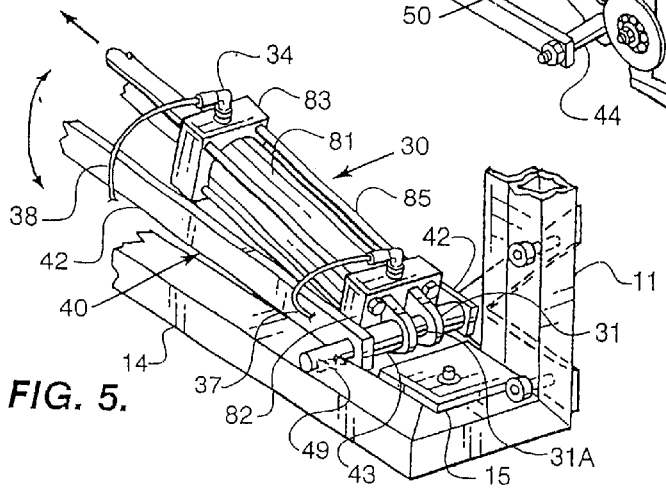
FIG. 5 is a perspective view of the tension assembly arm and air activated cylinder at their point of attachment to the support frame.

As shown in FIG. 5, the tension arm assembly 40 and air actuated cylinder 30 are pivotally attached as a unit to support frame 10 by means of pivot shaft 43 which extends between and through bars 42 at one end of the tension arm assembly 40. Support frame 10 is provided with a tension arm support 45 and, as shown best in FIG. 6A, support 45 includes horizontal brace 46 and angled brace 47 to form a generally triangular shaped support 45. The support is bolted to one of the vertical guide frames 11. As further shown in FIG. 5, one end of pneumatic cylinder 30 is provided with a pair of pivot ears 31. Pivot shaft 43 extends through one of bars 42, then through bore 31*a* of each pivot ear 31, then through the other bar 42, and then into tension arm support 45 at 48. Shaft 43 is welded on base 14 at 49. By virtue of this mounting technique, the tension arm assembly 40 and pneumatic cylinder 30 can easily pivot in an upward or downward direction.

Pneumatic cylinder 30 is of the double acting piston type. That is, within the interior of the cylinder is a piston which can be actuated by fluid (either gas or liquid) under pressure. When pressurized air is applied to one side of the piston, it will cause the piston to move away from the air source. When pressurized air is applied to the opposite side of the piston, again the piston will move away from the pressurized air source. Thus, through appropriate valving and pressure control, one can control the direction of movement of the piston. When the portable pneumatic target device 1 is to be mounted to a vertical surface, such as a wall, then a double acting piston should be used so as to insure adequate retraction of the device. A suitable double acting air actuated cylinder is available from Fluid Connector Products, Inc. as model 2 1/2 PU16X8.

As shown in FIG. 5, pneumatic cylinder 30 includes cylinder body 81, heads 82 and 83 at each end of the cylinder body and tie rods 85 which firmly secure the heads to the cylinder body. Piston 84, shown in phantom in FIG. 6D, is positioned in the interior of cylinder 30. Piston rod 35 is secured to piston 84 and extends outward from the pneumatic cylinder through head 83. As shown in FIG. 5, pneumatic hose 38 is connected to head 83 at one end of the pneumatic cylinder through fitting 34. So too, pneumatic hose 37 is connected to the opposite end of cylinder 30 to head 82 through fitting 33. Air under pressure from pneumatic hose 38 enters cylinder body 81 and can act against a side of piston 84. Air under pressure from pneumatic hose 37 enters the cylinder body 81 and can act against the opposite side of piston 84.

Figure 2:
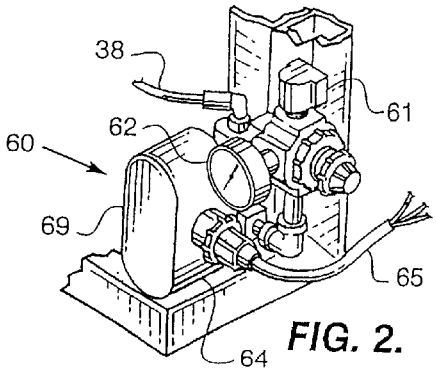
FIG. 2 is a perspective view of the solenoid control.
Figure 3:
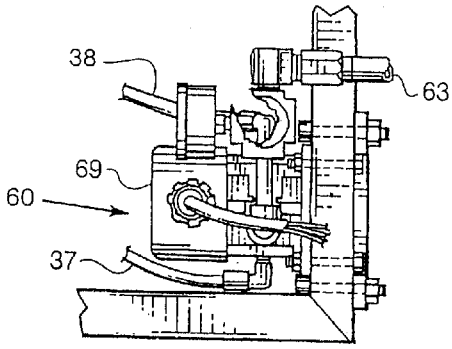
FIG. 3 is a side elevational view of the solenoid control.

Another important component in this target raising and lowering system is the solenoid activated pneumatic control 60, for it is this control, acting in concert with the other major components, that allows a target not only to be generally raised or lowered, but, in connection with pneumatic cylinder 30, allows the user to selectively stop the target at any point of extension. As shown in FIGS. 2 and 3, solenoid control 60 includes solenoid actuated valve 69, power supply cord (12V) 65, inlet air pressure hose 63, and pressure regulator 61. In one embodiment of the invention, the source of air under pressure is a compressed air cylinder, such as a scuba tank. This embodiment allows for increased portability of the invention. Because the device can be run utilizing a 12V power supply, a 12V battery, such as a car battery, can be used to power the device. Pressure regulator 61 controls the pressure of the air which enters the solenoid activated control 60. By adjusting regulator 61, the user can control the speed at which the target assembly is raised or lowered. Gauge 62 allows the user to monitor the pressure.

To complete the components included in the target raising and lowering assembly, reference is again made to FIG. 1. As previously noted, air actuated cylinder 30 is supplied with piston rod 35, which is secured to piston 84 and extends outward from cylinder 30 through head 83. As shown best in FIG. 6D, mounted to the end of piston rod 35 is adjustable coupler 36, which is threaded to the end of piston rod 35. This allows the coupler to be adjusted lengthwise as may be necessary.

As shown in FIGS. 1 and 6C, idler arm 50 is operably connected between piston rod 35 and carrier assembly 20. More particularly, one end of the idler arm is pivotally mounted to shaft 44 of tension arm assembly 40. That is, one end of idler arm 50 has opening 52 which accommodates shaft 44. The exposed end of coupler 36 is U-shaped and surrounds the idler arm and is pivotally connected at about the mid-point of the arm by means of threaded pin 54, which goes through opening 53 of the idler arm.

Figure 4:
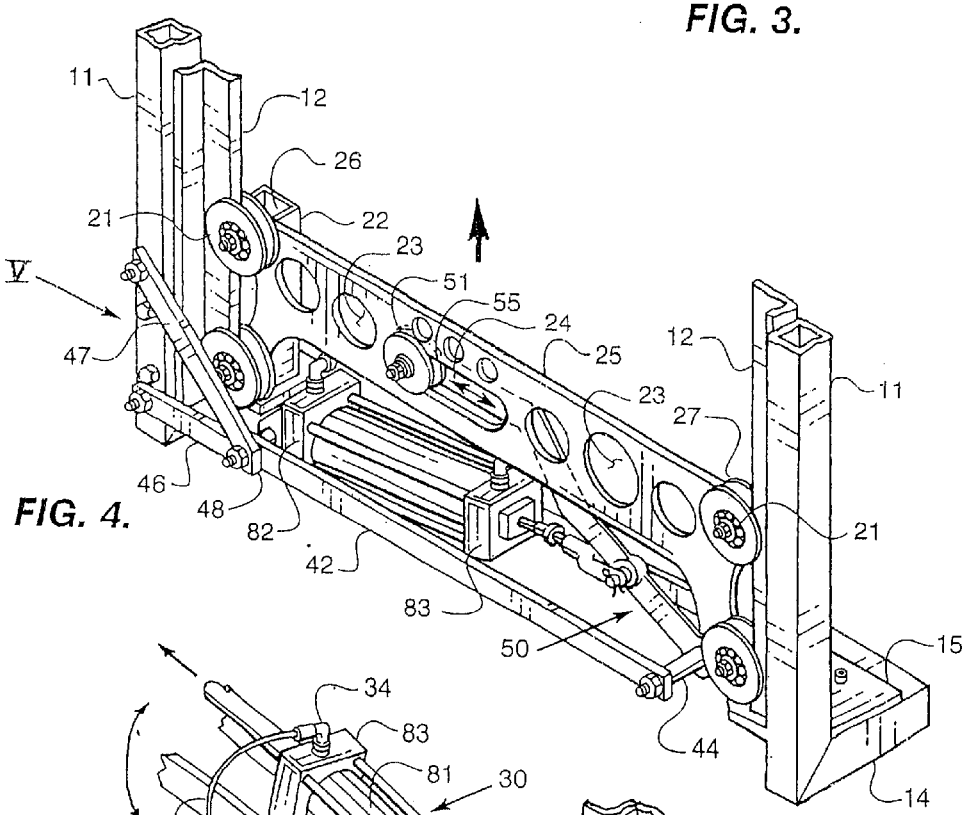
FIG. 4 is a rear perspective view of the lower portion of the target device of the present invention.

As shown in FIG. 6C, an idler wheel 51 is rotatably mounted on the end of idler arm 50 and is provided with a groove 55 about its circumference. As shown best in FIG. 6B, plate 25 of target carrier assembly 20 is provided with longitudinal slot 24. As shown in FIGS. 1 and 4, idler wheel 51 is positioned within slot 24 so that groove 55 of the idler wheel tracks on the edges of slot 24. Since idler wheel 51 is mounted on the end of idler 50, this allows the idler arm to move longitudinally within the slot.

In one embodiment of the invention, the user controls the action of the target raising and lowering device by means of a three position switch, many types of which are commonly known in the art. The switch is attached to and supplies control input to the target raising and lowering device through wires in power supply cord 65. When the user wishes to raise the target from the ready position, the user activates the appropriate switch on the control. Cord 65 carries the signal from the control to solenoid valve 69. The solenoid valve 69 then directs pressurized air through hose 37 and into head 82 of air actuated cylinder 30. Once inside the cylinder, the pressurized air acts against the side of piston 84 nearest to head 82 causing the piston and its attached piston rod 35 to be pushed away from head 82. As best shown in FIG. 1, as piston rod 35 is pushed away from head 82 of cylinder 30, idler arm 50, attached to piston rod 35 by adjustable coupler 36, begins to assume a more vertical position. As the idler arm moves into a more vertical position, it moves the target carrier assembly 20, connected to the idler arm at the extension roller relief slot 24 by the extension roller 51, upwardly along the carrier guide rails 12. Consequently, when pressurized air acts against the side of piston 84 closest to head 82, the target carrier assembly 20 and the target it is carrying are raised.

If a pneumatic cylinder of the double acting piston type is employed, the user can selectively stop the target raising and lowering device at any point of target elevation or retraction. During the time the action of the target raising and lowering device is stopped, the solenoid valve 69 functions to balance air pressure on either side of piston 84, and thereby maintain the target at a given point of elevation.

When the user wishes to lower the device, the appropriate switch on the control is activated. The solenoid valve then allows pressurized air to flow through hose 38 and into head 83 while at the same time allowing air to flow from hose 37 and back into the solenoid valve. Pressurized air acts against the side of piston 84 closest to head 83, which causes the piston and attached rod 35 to move away from the source of pressurized air, and, therefore, away from head 83. As piston rod 35 is forced back into cylinder body 81, idler arm 50 is lowered. As idler arm 50 is lowered, target carrier assembly 20 is also correspondingly lowered. Accordingly, by means of a control switch in conjunction with solenoid control 60, air actuated cylinder 30, idler arm 50, target carrier assembly 20, and the other components of the target raising and lowering device described above, a target can be raised, lowered, or stopped at any given position using the device of the present invention.

Figures 7, 7A:
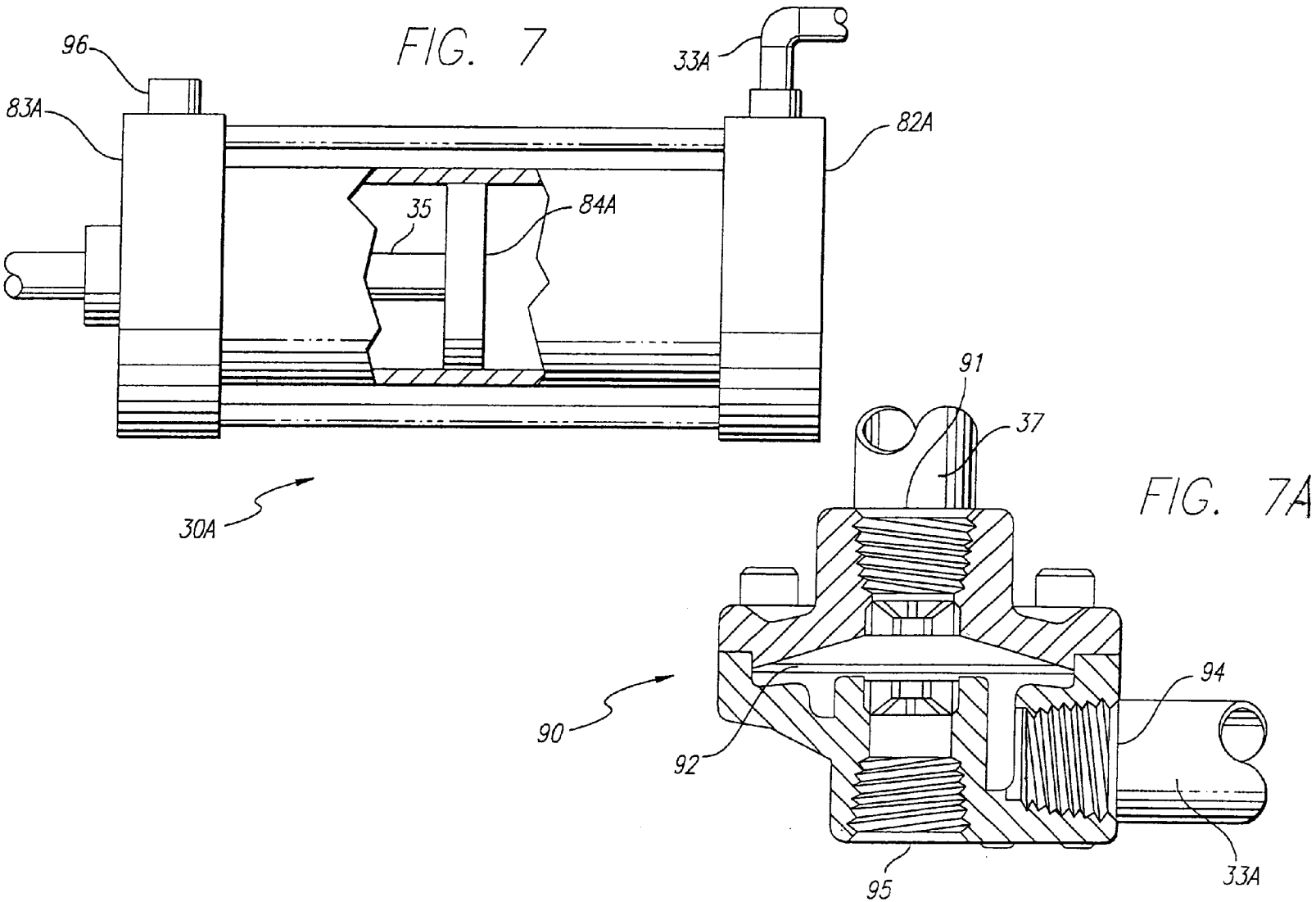
FIG. 7 is a sectional view of a single acting pneumatic cylinder.
FIG. 7A is a sectional view of a quick exhaust and shuttle valve.

When the portable pneumatic target device of the present invention is placed on a horizontal surface, an air actuated cylinder with either a double or a single acting piston can be employed, it being presently preferred that a single acting piston be used when the device is placed on a horizontal surface. A pneumatic cylinder with a single acting piston is shown in FIG. 7 and is available from Parker as model number 2.50CB2MA13AX8.00. In this embodiment, pneumatic cylinder 30A is secured to tension arm assembly 40 and support frame 10 as previously described with respect to double acting cylinder 30. As shown in FIG. 7A a quick exhaust and shuttle valve 90 is used to connect pneumatic hose 37 from a source of pressurized air to fitting 33A on head 82A of cylinder 30A such that air under pressure from hose 37 must pass through valve 90 and then enter cylinder 30A through fitting 33A. Pneumatic hose 37 is threadedly engaged with valve 90 at opening 91. Opening 94 of valve 90 is then threadedly engaged with fitting 33A of cylinder 30A.

Air under pressure from pneumatic hose 37 enters valve 90 at opening 91 and acts against diaphragm 92 causing movement of diaphragm 92 so that the air under pressure is allowed to flow from valve 90 through fitting 33A and into pneumatic cylinder 30A. Upon entering the cylinder body, the pressurized air acts against a side of piston 84A. When the supply of air under pressure is shut off, the diaphragm returns to its resting position as shown in FIG. 7A. In the resting position, air from cylinder 30A is allowed to travel back into valve 90 and is exhausted from the valve at exhaust port 95. As shown in FIG. 7, inlet port 96 on head 83A of cylinder 30A permits air to enter the side of the cylinder body adjacent to head 83A so that a vacuum is not formed in the cylinder as piston 84A moves toward head 82A. A preferred quick exhaust and shuttle valve is available from Parker Pneumatic.

Figure 9:
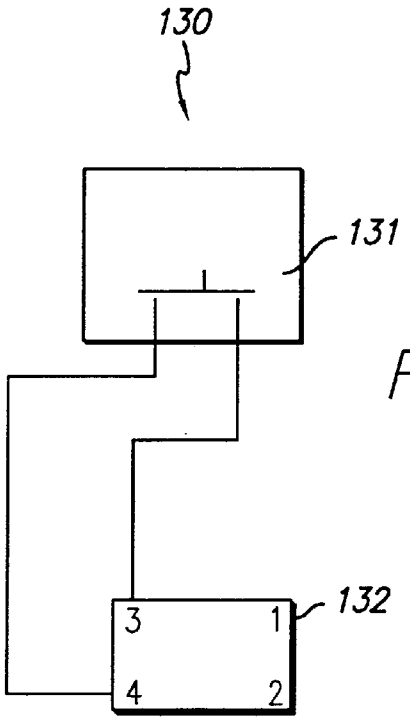
FIG. 9 is an electrical schematic view of a manual activation device used to actuate the portable target device.

A preferred means of target activation which can be used with pneumatic cylinder 30A of the single acting piston type is a manual activation device 130 as shown in FIG. 9. Manual activation device 130 is operably connected to programmable timer 102, shown in FIG. 10, by inserting 4-pronged plug 132 into socket 103 of timer 102. In this embodiment, when power is supplied to the solenoid valve 69A, switch 131 is depressed to actuate the device. Depressing switch 131 closes the circuit between positive 12VDC and trigger terminal 104 on programmable timer 102 and starts the timing interval. The timing interval is set by adjusting potentiometer 106 on programmable timer 102. The length of the timing interval determines the length of time air is supplied to pneumatic cylinder 30A. Dip switch 105 on timer 102 should be set so that the relay 112 on programmable timer 102 energizes at the start of the timing cycle. At the start of the timing cycle, relay 112 closes, which allows electricity to flow to solenoid valve 69A. The solenoid valve 69A then directs pressurized air through hose 37, into quick exhaust and shuttle valve 90, then through fitting 33A and into pneumatic cylinder 30A through head 82A. At the end of the timing interval, relay 112 opens, electricity to solenoid valve 69A is shut off, and solenoid valve 69A stops pressurized air from flowing into pneumatic cylinder 30A. A preferred programmable timer is available from Altronix as model 6062.

Figure 8:
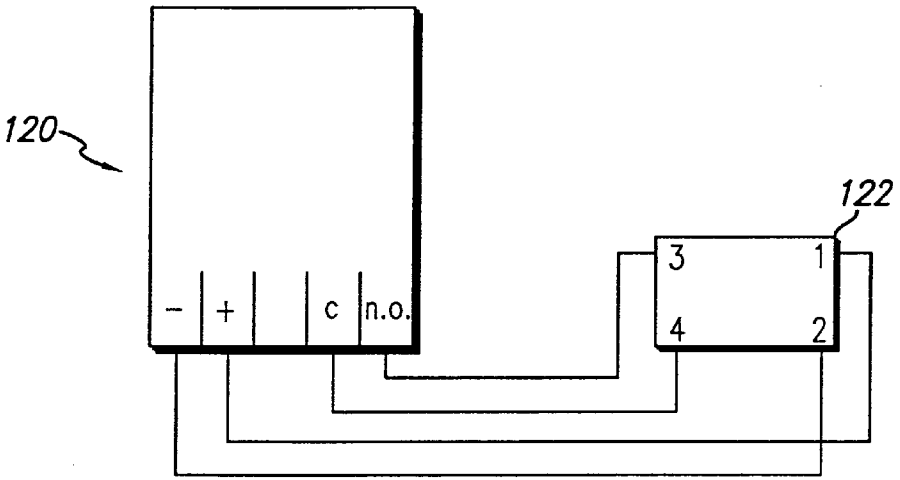
FIG. 8 is an electrical schematic view of an infrared device used to actuate the portable target device.

In another preferred embodiment of the invention, an infrared device 120 as shown in FIG. 8 is used as a means of automatically actuating the portable pneumatic target device of the present invention. The infrared device 120 is also used in conjunction with pneumatic cylinder 30A of the single acting piston type. Infrared device 120 is operably connected to programmable timer 102, shown in FIG. 10, by inserting 4-pronged plug 122 into socket 103 of timer 102. In this embodiment, infrared device 120 is triggered when the device senses that the infrared beams it is emitting are interrupted. When infrared device 120 is triggered, the circuit between positive 12VDC and trigger terminal 104 on programmable timer 102 is closed and the timing interval is started. At the start of the timing cycle, relay 112 on programmable timer 102 closes, which allows electricity to flow to solenoid valve 69A. The solenoid valve 69A then directs pressurized air through hose 37, into quick exhaust and shuttle valve 90, then through fitting 33A and into pneumatic cylinder 30A through head 82A. At the end of the timing interval, relay 112 opens, electricity to solenoid valve 69A is shut off, and solenoid valve 69A stops pressurized air from flowing into pneumatic cylinder 30A. A preferred infrared device is available from Crow Electronic Engineering Ltd. as part number 7101004. An ultrasonic sensor can be used in place of an infrared sensor in this embodiment.

Figure 10:
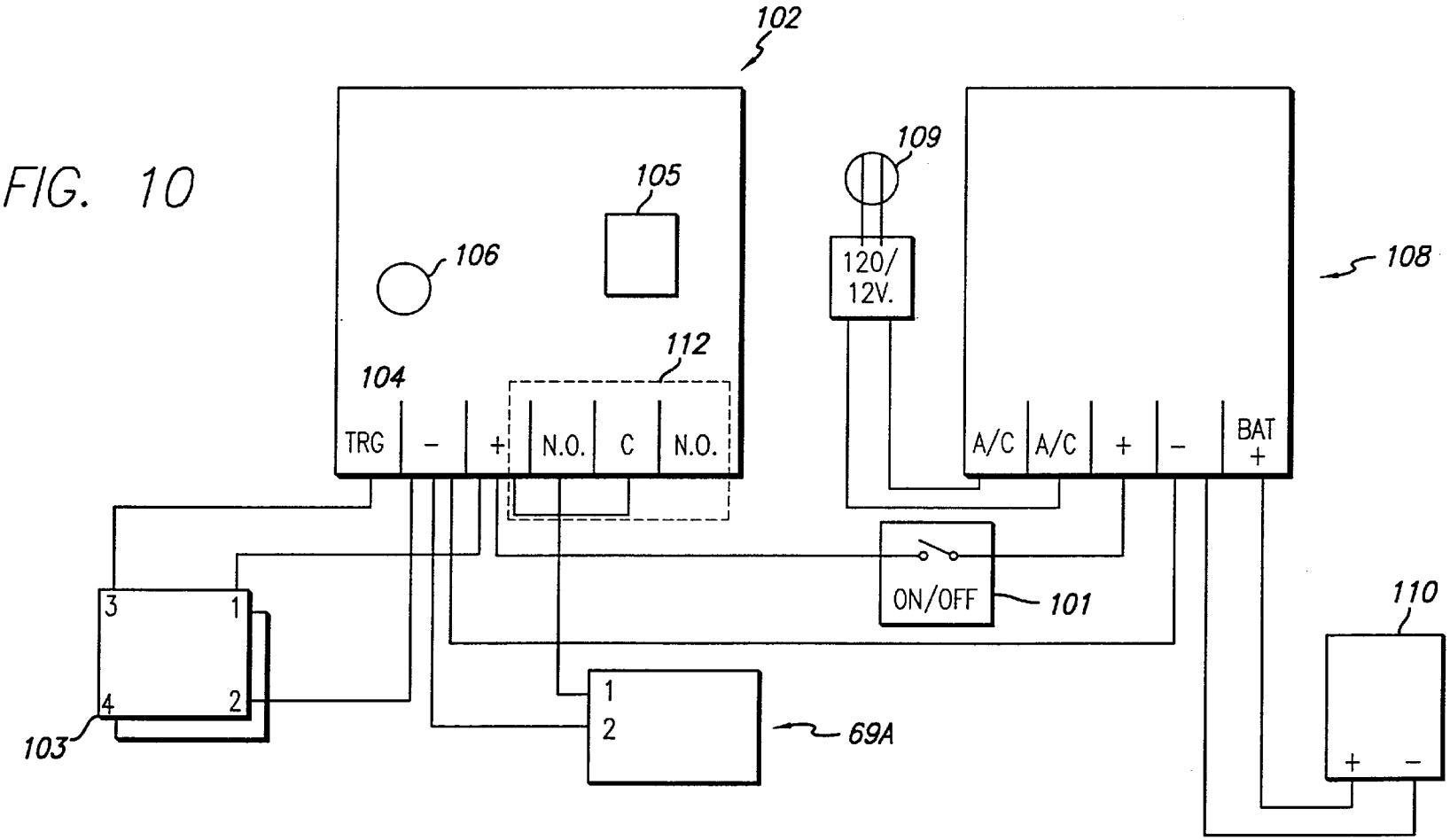
FIG. 10 is an electrical schematic view of a portable control unit which is actuated by either an infrared device or a manual activation device.

The portable pneumatic target device of the present invention can be plugged into an a/c power source 109, shown in FIG. 10, or can be run by battery. When the device is plugged into an a/c power source, infrared device 120 (if used), solenoid valve 69A, programmable timer 102, and power supply/charger 108 are powered and battery 110 is charged. When the device is plugged into a source of a/c power, power supply/charger 108 directs power to the electric components of the portable pneumatic target device and also charges battery 110. When the device is not plugged into a source of a/c power, battery 110 powers the electric components of the target device. A suitable power supply/charger is available from Altronix as model AL612.

As shown best in FIGS. 7 and 7A, when the manual activation device 130 or infrared device 120 is activated causing solenoid valve 69A to open, air under pressure travels through pneumatic hose 37 and into quick exhaust and shuttle valve 90. Once within the valve, the air under pressure acts against diaphragm 92, causing the diaphragm to move so that the air under pressure is allowed to exit valve 90 through opening 94. Fitting 33A in head 82A connects cylinder 30A to valve 90. Accordingly, air under pressure travels through opening 94, through fitting 33A, and into cylinder 30A. Once within the cylinder, air under pressure acts against the side of piston 84A nearest to head 82A causing the piston and its attached piston rod 35 to be pushed away from head 82A. As best shown in FIG. 1, as piston rod 35 is pushed away from head 82A of cylinder 30A, idler arm 50, attached to piston rod 35 by adjustable coupler 36, begins to assume a more vertical position. As the idler arm moves into a more vertical position, it moves the target carrier assembly 20, connected to the idler arm at the extension roller relief slot 24 by the extension roller 51, upwardly along the carrier guide rails 12. Consequently, when pressurized air acts against the side of piston 84A closest to head 82A, the target carrier assembly 20 and the target it is carrying are raised.

At the end of the timing interval discussed above, the supply of air under pressure is shut off. Because air under pressure is no longer traveling through valve 90 and acting against diaphragm 92, diaphragm 92 returns to its resting position. Air from cylinder 30A is permitted to exit the cylinder through exhaust port 95 in valve 90. When air under pressure no longer acts against piston 84A, target carrier assembly 20 begins to fall as a result of gravity. As target carrier assembly 20 moves downwardly along carrier guide rails 12, idler arm 50 moves into a more horizontal position, piston rod 35, attached to idler arm 50 by adjustable coupler 36, acts against piston 84A such that piston 84A moves back toward head 82A of cylinder 30A. As piston 84A moves toward head 82A, air from cylinder 30A is expelled through exhaust port 95 of valve 90.

What is claimed is:

1. A device for raising and lowering a target and for selectively stopping the target at any point of extension or retraction comprising:

A) a support frame secured to a base, said support frame including a pair of parallel, spaced apart guide frame bars secured to said base, each of said guide frame bars being provided with a guide frame rail;

B) a target carrier assembly positioned between said guide frame bars and moveable along the length thereof, said target carrier assembly including:

1) guide rail wheels which engage said guide frame rails; and 2) means for receiving a target;

C) target positioning apparatus for raising and lowering said carrier assembly and selectively stopping said assembly at a variety of points, said target positioning apparatus including:

1) a cylinder pivotally mounted at one end to said frame, said cylinder having an internally mounted, moveable piston with the interior of said cylinder being coupled to a source of fluid under pressure;

2) control means for selectively directing said fluid under pressure to at least one side of said piston, thereby causing movement of said piston within said cylinder, said control means including:

a) a valve operated by a solenoid, said valve operatively disposed intermediate said source of fluid under pressure and said at least one side of said piston; and b) a programmable timer electrically coupled to said solenoid to selectively control the timing interval during which said valve directs fluid flow from said source to said at least one side of said piston; and (3) mechanical coupling means for transmitting said piston movement to said target carrier assembly, said mechanical coupling means including;

a) a piston rod secured to said piston and extending from said cylinder;

b) a tension bar assembly having a first end thereof pivotally mounted to said frame; and c) an idler arm, a first end of said idler arm being pivotally connected to a second end of said tension bar assembly and a second end of said idler arm being coupled to said target carrier assembly with the end of said piston rod being pivotally connected to said idler arm at a point between the ends thereof, such that movement of said piston rod is transmitted to said carrier assembly by said idler arm.

2. The target raising and lowering device of claim 1 wherein activating a manual control device initiates said timing interval of said programmable timer, causing said valve means to direct fluid flow to said at least one side of said piston during said timing interval.

3. The target raising and lowering device of claim 1 wherein the activation of an infrared device initiates said timing interval of said programmable timer, causing said valve means to direct fluid flow to at least one side of said piston during said timing interval.

4. The target raising and lowering device of claim 2 wherein said moveable piston is of the double acting type.

5. The target raising and lowering device of claim 2 wherein said moveable piston is of the single acting type.

6. The target raising and lowering device of claim 3 wherein said moveable piston is of the double acting type.

7. The target raising and lowering device of claim 3 wherein said moveable piston is of the single acting type.

* * * * *